US006325206B1

(12) United States Patent
Stonex

(10) Patent No.: US 6,325,206 B1
(45) Date of Patent: Dec. 4, 2001

(54) PAINTING KIT

(76) Inventor: Susan Stonex, 1450 Hialeah #D, Las Vegas, NV (US) 89119

( * ) Notice: Subject to any disclaimer, the term of this patent is extended or adjusted under 35 U.S.C. 154(b) by 0 days.

(21) Appl. No.: 09/586,019

(22) Filed: Jun. 2, 2000

(51) Int. Cl.[7] ..... B44D 3/02

(52) U.S. Cl. ..... 206/1.8; 206/1.7; 206/575; 220/23.8; 108/43

(58) Field of Search ..... 206/575, 1.7, 1.8, 206/1.9, 564

(56) References Cited

U.S. PATENT DOCUMENTS

| | | | | |
|---|---|---|---|---|
| D. 393,775 | | 4/1998 | Otero . | |
| 2,565,912 | | 8/1951 | Davis . | |
| 3,023,884 | | 3/1962 | Schwartz . | |
| 3,139,208 | * | 6/1964 | Irwin et al. | 220/23.8 |
| 3,650,380 | * | 3/1972 | Hutchison | 206/1.8 |
| 3,804,030 | * | 4/1974 | Israel | 108/43 |
| 4,046,250 | | 9/1977 | Amezucua . | |
| 4,444,306 | * | 4/1984 | Benaquista | 206/1.7 |
| 4,690,271 | * | 9/1987 | Zak | 206/1.7 |
| 4,901,850 | | 2/1990 | Mcintosh . | |
| 5,074,239 | | 12/1991 | Law . | |

* cited by examiner

*Primary Examiner*—Paul T. Sewell
*Assistant Examiner*—Troy Arnold

(57) ABSTRACT

A painting kit for holding paints and water. The painting kit includes a vessel having a bottom wall. The bottom wall has a top surface. A peripheral wall extends upward from in the bottom wall. A plurality of containers for holding paint is fixedly mounted on the upper surface of the bottom wall. A plurality of lids for covering the containers have shape adapted to fit over the top openings of one of the containers. A bowl for containing water is placed in the vessel.

14 Claims, 2 Drawing Sheets

PAINTING KIT

BACKGROUND OF THE INVENTION

1. Field of the Invention

The present invention relates to painting sets and more particularly pertains to a new painting kit for holding paints and water.

2. Description of the Prior Art

The use of painting sets is known in the prior art. More specifically, planting sets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,565,912; U.S. Pat. No. 4,046,250; U.S. Pat. No. 3,023,884; U.S. Pat. Des. No. 393,775; U.S. Pat. No. 4,901,850; and U.S. Pat. No. 5,074,239.

While these devices fulfill their respective, particular objectives and requirements, the aforementioned patents do not disclose a new painting kit. The inventive device includes a vessel having a bottom wall. The bottom wall has a top surface. A peripheral wall extends upward from the bottom wall. A plurality of containers for holding paint is fixedly mounted on the upper surface of the bottom wall. A plurality of lids for covering the containers have shape adapted to fit over the top openings of one of the containers. A bowl for containing water is placed in the vessel.

In these respects, the painting kit according to the present invention substantially departs from the conventional concepts and designs of the prior art, and in so doing provides an apparatus primarily developed for the purpose of holding paints and water.

SUMMARY OF THE INVENTION

In view of the foregoing disadvantages inherent in the known types of painting sets now present in the prior art, the present invention provides a new painting kit construction wherein the same can be utilized for holding paints and water.

The general purpose of the present invention, which will be described subsequently in greater detail, is to provide a new painting kit apparatus and method which has many of the advantages of the painting sets mentioned heretofore and many novel features that result in a new painting kit which is not anticipated, rendered obvious, suggested, or even implied by any of the prior art painting sets, either alone or in any combination thereof.

To attain this, the present invention generally comprises a vessel having a bottom wall. The bottom wall has a top surface. A peripheral wall extends upward from the bottom wall. A plurality of containers for holding paint is fixedly mounted on the upper surface of the bottom wall. A plurality of lids for covering the containers have shape adapted to fit over the top openings of one of the containers. A bowl for containing water is placed in the vessel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be under stood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new painting kit apparatus and method which has many of the advantages of the painting sets mentioned heretofore and many novel features that result in a new painting kit which is not anticipated, rendered obvious, suggested, or even implied by any of the prior art painting sets, either alone or in any combination thereof.

It is another object of the present invention to provide a new painting kit which may be easily and efficiently manufactured and marketed.

It is a further object of the present invention to provide a new painting kit which is of a durable and reliable construction.

An even further object of the present invention is to provide a new painting kit which is susceptible of a low cost of manufacture with regard to both materials and labor, and which accordingly is then susceptible of low prices of sale to the consuming public, thereby making such painting kit economically available to the buying public.

Still yet another object of the present invention is to provide a new painting kit which provides in the apparatuses and methods of the prior art some of the advantages thereof, while simultaneously overcoming some of the disadvantages normally associated therewith.

Still another object of the present invention is to provide a new painting kit fori holding paints and water.

Yet another object of the present invention is to provide a new painting kit which includes a vessel having a bottom wall. The bottom wall has a top surface. A peripheral wall extends upward from the bottom wall. A plurality of containers for holding paint is fixedly mounted on the upper surface of the bottom wall. A plurality of lids for covering the containers have shape adapted to fit over the top openings of one of the containers. A bowl for containing water is placed in the vessel.

Still yet another object of the present invention is to provide a new painting kit that has paint containers fixedly mounted to the vessel to prevent spillage and for easier access since they will not slide around when a brush is placed in them.

Even still another object of the present invention is to provide a new painting kit that has an absorptive material therein for containing water spillage and for drying paint brushes.

Still another object of the present invention is provide a new painting kit which can be modified for watercolors water based paint or oil based paint.

These together with other objects of the invention, along with the various features of novelty which characterize the invention, are pointed out with particularity in the claims annexed to and forming, a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
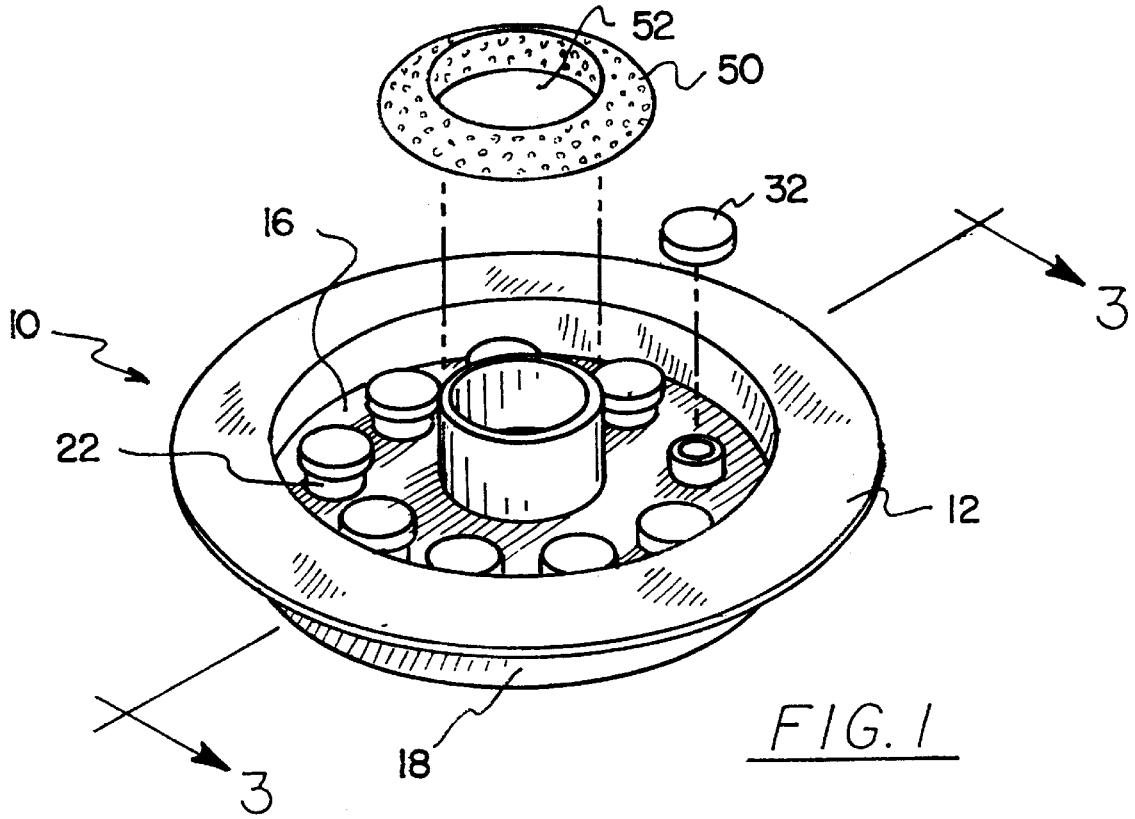
FIG. 1 is a schematic perspective view of a new painting kit according to the present invention.
Figure 2:
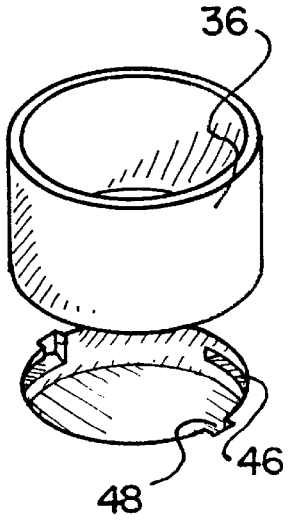
FIG. 2 is a schematic perspective view of the bowl of the present invention.
Figure 3:
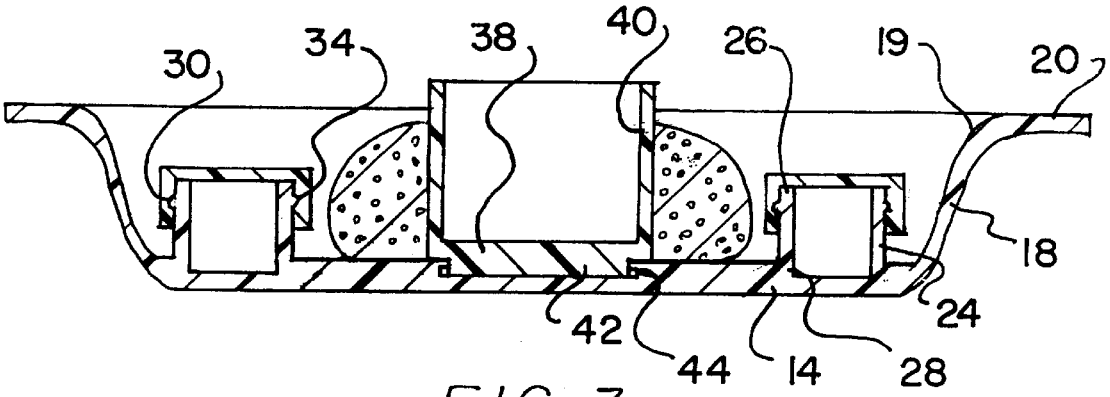
FIG. 3 ia schematic side view taken along line 3—3 of the present invention.

With reference now to the drawings, and in particular to FIGS. 1 through 3 thereof, a new painting kit embodying the principles and concepts of the present invention and generally designated by the reference numeral 10 will he described.

As best illustrated in FIGS. 1 through 3, the painting kit 10 generally comprises a vessel 12. The vessel 12 has a bottom wall 14. The bottom wall has a top surface 16. A peripheral wall 18 extends upward from the bottom wall. The peripheral wall has a the top edge 19. A lip 20 is fixedly coupled to and extends away from the top edge 19. The bottom wall 14 has a generally circular shape. The lip 20 is a generally annular lip and extends substantially parallel to the bottom wall 14.

A plurality of containers 22 for holding paint is fixedly mounted on the tippeI surface 16 of the bottom wall 14. Each of the containers 22 is generally adjacent to the peripheral wall 18. The containers 22 each have a wall 24 with a top edge 26 and a bottom edge 28, wherein the top edge 26 defines an opening. Each of the walls 24 of the containers 22 has an annular ridge 30 on an outer surface of the container 22. The annular ridges 30 are located generally adjacent to the top edges 26 of the containers 22. Preferably, the containers 22 are generally circular and are arranged in a circle in the vessel 12.

A plurality of lids 32 for covering the containers 22 has a shape adapted to fit over the top openings of one of the containers 22. Each of the lids 32 has an annular groove 34 therein for receiving the annular ridge 30 on the containers 22 such that each of the lids 32 removably snaps onto the containers 22.

A bowl 36 for containing water has a bottom wall 38 and a side wall 40. Ideally, the bottom wall 38 has an exterior surface having protrusion thereon 42. The protrusion 42 extends away from the bottom wall 38 of the bowl 36 and has a peripheral edge. Two tabs 44 are located on the peripheral edge of the protrusion 42. The tabs 44 extend in opposite directions from each other.

Ideally. a well 46 is in the Sur face of the bottom wall 14 of the vessel 12 for receiving the protrusion 42 on the bowl 36. The well 46 has a peripheral edge having two slots 48 therein for receiving the tabs 44 on the protrusion 42. The slots 48 are located in the peripheral edge of the well 46 and extend in opposite directions from each other.

Preferably, an absorptive member 50 collects water spillage. The absorptive member 50 also provides a place to dry a paint brush after removal from water in the bowl 36. The absorptive member 50 has a bore 52 therein. The bore 52 has a size adapted to fit around an exterior surface of the bowl 36 such that the absorptive member 50 absorbs liquid spilling from over an upper edge of the bowl 50. Preferably, the absorptive member 50 has a generally circular shape. Ideally, the absorptive member has a frusto-conical shape, as is shown in FIG. 1, so that bottom side is flat and has and outer edge which is substantially adjacent to the bottom edges of the containers. This will prevent liquid and paint from spilling between the containers and the bowl. The absorptive member 50 preferably comprises a sponge.

In use, the bowl 36 is filled with water. The lids 32 of the containers 22 are removed to expose the paint. Painting is thereafter accomplished as known in the art.

As to a further discussion of the manner of usage and operation of the present invention, the same should be apparent from the above description. Accordingly, no further discussion relating, to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for holding paints, comprising:

a vessel, said vessel having a bottom wall, said bottom wall having a top surface, a peripheral wall extends upward from said bottom wall;

a plurality of containers for holding paint, said holders being fixedly mounted on said top surface of said bottom wall; and a plurality of lids for covering said containers, each of said lids having a shape adapted to fit over said top opening of one of said containers;

a bowl for containing water, said bowl being placed in said vessel;

an absorptive member for collecting water spillage, said absorptive member having a bore therein, said bore having a size adapted to fit around an exterior surface of said bowl such that liquid spilling from over an upper edge of said bowl is absorbed by said absorptive member.

2. The apparatus for holding paints as in claim 1, wherein said peripheral wall of said vessel has a said top edge, a lip being fixedly coupled to and extending away from said top edge, said bottom wall having a generally circular shape, said lip being a generally annular lip, said lip extending substantially parallel to said bottom wall.

3. The apparatus for holding paints as in claim 1, wherein:

each of said containers is generally adjacent to said peripheral wall, each of said containers having a wall with a top edge and a bottom edge, said top edge defining an opening, each of said walls of said containers having an annular ridge on an outer surface of said container, each of said annular ridges being located generally adjacent to said top edges of said containers, said containers being generally circular, said containers being arranged in a circle; and each of said lids has an annular groove therein for receiving said annular ridge on said containers such that each of said lids removably snaps onto said containers.

4. The apparatus for holding paints as in claim 1, further comprising:

said bowl having a bottom wall and a side wall, said bottom wall having an exterior surface, said exterior surface of said bottom wall having a protrusion thereon, said protrusion extending away from said bottom wall of said bowl, said protrusion having a peripheral edge, said protrusion having at least two tabs thereon, said tabs being located on said peripheral edge of said protrusion, each of said tabs extending in opposite directions from each other; and a well in said surface of said bottom wall of said vessel for receiving said protrusion on said bowl, said well having a peripheral edges said well having at least two slots therein for receiving said tabs on said protrusion, said slots being located in said peripheral edge of said well, said slots extending in opposite directions from each other.

5. An apparatus for holding paints, comprising:

a vessel, said vessel having a bottom wall, said bottom wall having a top surface, a peripheral wall extends upward from said bottom wall, said peripheral wall having a said top edge, a lip being fixedly coupled to and extending away from said top edge, said bottom wall having a generally circular shape, said lip being a generally annular lip, said lip extending substantially parallel to said bottom wall;

a plurality of containers for holding paint, said holders being fixedly mounted on said top surface of said bottom wall, each of said containers being generally adjacent to said peripheral wall, each of said containers having a wall with a top edge and a bottom edge, said top edge defining an opening, each of said walls of said containers having an annular ridge on an outer surface of said container, each of said annular ridges being located generally adjacent to said top edges of said containers, said containers being generally circular, said containers being arranged in a circle;

a plurality of lids for covering said containers, each of said lids having a shape adapted to fit over said top openings of one of said containers, each of said lids having an annular groove therein for receiving said annular ridge on said containers such that each of said lids removably snaps onto said containers;

a bowl for containing water, said bowl having a bottom wall and a side wall, said bottom wall having an exterior surface, said exterior surface of said bottom wall having a protrusion thereon, said protrusion extending away from said bottom wall of said bowl, said protrusion having a peripheral edge, said protrusion having two tabs thereon, each of said tabs being located on said peripheral edge of said protrusion, each of said tabs extending in opposite directions from each other;

a well in said top surface of said bottom wall of said vessel for receiving said protrusion on said bowl, said well having a peripheral edge, said well having two slots therein for receiving said tabs on said protrusion, said slots being located in said peripheral edge of said well, said slots extending in opposite directions from each other;

an absorptive member for collecting water spillage, said absorptive member providing a place to dry a paint brush after removal from water in said bowl, said absorptive member having a bore therein, said bore having a size adapted to fit around an exterior surface of said bowl such that liquid spilling from over an upper edge of said bowl is absorbed by said absorptive member, said absorptive member having a generally circular shape, wherein said absorptive member comprises a sponge.

6. An apparatus for holding paints, comprising:

a vessel having a bottom wall, said bottom wall having a top surface, a peripheral wall extending upwardly from said bottom wall;

a plurality of containers for holding paint, said holders being mounted on said upper surface of said bottom wall;

a bowl for containing water, said bowl having a perimeter, said bowl being located in said vessel; and an absorptive member for collecting water spillage, said absorptive member extending about the perimeter of said bowl such that liquid spilling over an upper edge of said bowl is absorbed by said absorptive member.

7. The apparatus for holding paints as in claim 6, additionally comprising a plurality of lids for covering said containers, each of said lids being adapted to fit over said top opening of one of said containers.

8. The apparatus for holding paints as in claim 6, wherein said peripheral wall of said vessel has a said top edge, a lip being fixedly coupled to and extending away from said top edge, said bottom wall having a generally circular shape, said lip being a generally annular lip, said lip extending substantially parallel to said bottom wall.

9. The apparatus for holding paints as in claim 6, wherein each of said containers is positioned generally adjacent to said peripheral wall substantially in a circle.

10. The apparatus for holding paints as in claim 6, wherein each of said containers has a wall with a top edge and a bottom edge, said top edge defining an opening, said containers being generally circular.

11. The apparatus for holding paints as in claim 10, wherein each of said walls of said containers has an annular ridge on an outer surface of said container, each of said annular ridges being located generally adjacent to said top edges of said containers, each of said lids having an annular groove therein for receiving said annular ridge on said containers such that each of said lids removably snaps onto said containers.

12. The apparatus for holding paints as in claim 6, wherein said bowl has a bottom wall and a side wall, said bottom wall having an exterior surface, said exterior surface of said bottom wall having a protrusion thereon, said protrusion extending away from said bottom wall of said bowl, said protrusion having a peripheral edge.

13. The apparatus for holding paints as in claim 12, wherein a well is formed in said top surface of said bottom wall of said vessel for receiving said protrusion on said bowl, said well having a peripheral edge.

14. The apparatus for holding paints as in claim 13, wherein said protrusion has at least two tabs thereon, said tabs being located on said peripheral edge of said protrusion, each of said tabs extending in opposite directions from each other, and wherein said well has at least two slots therein for receiving said tabs on said protrusion, said slots being located in said peripheral edge of said well, said slots extending in opposite directions from each other.

* * * * *